US008359896B2

(12) United States Patent
Wolf

(10) Patent No.: US 8,359,896 B2
(45) Date of Patent: Jan. 29, 2013

(54) SUPPORT JAW ARRANGEMENT FOR SLIDING LATERAL SUPPORT OF ROD-SHAPED AND TUBULAR WORKPIECES IN BENDING MACHINES

(75) Inventor: Jürgen Wolf, Walddorfhäslach (DE)

(73) Assignee: WAFIOS Aktiengesellschaft, Reutlingen (DE)

( * ) Notice: Subject to any disclaimer, the term of this patent is extended or adjusted under 35 U.S.C. 154(b) by 562 days.

(21) Appl. No.: 12/579,990

(22) Filed: Oct. 15, 2009

(65) Prior Publication Data

US 2010/0095732 A1 Apr. 22, 2010

(30) Foreign Application Priority Data

Oct. 17, 2008 (EP) ..... 08018255

(51) Int. Cl.
*B21D 11/00* (2006.01)

(52) U.S. Cl. ..... 72/307; 72/149; 72/156; 72/311

(58) Field of Classification Search ..... 72/133, 72/149, 159, 306, 307, 418, 419, 420, 421, 72/293, 295, 301, 311, 155, 156
See application file for complete search history.

(56) References Cited

U.S. PATENT DOCUMENTS

| | | | | |
|---|---|---|---|---|
| 4,355,528 | A | 10/1982 | Rothenberger | |
| 4,945,747 | A | 8/1990 | Yogo | |
| 4,959,984 | A | 10/1990 | Trudell et al. | |
| 4,981,030 | A * | 1/1991 | Caporusso et al. | 72/158 |
| 5,495,740 | A | 3/1996 | Schwarz | |
| 5,499,522 | A | 3/1996 | Schwarze | |
| 5,950,474 | A * | 9/1999 | George et al. | 72/159 |
| 6,134,932 | A * | 10/2000 | Marque et al. | 72/149 |
| 6,185,968 | B1 | 2/2001 | Kanamori | |
| 6,434,995 | B1 * | 8/2002 | Kataoka et al. | 72/307 |
| 6,644,079 | B2 * | 11/2003 | Harman et al. | 72/15.4 |
| 6,694,794 | B2 | 2/2004 | Krippa | |
| 7,021,102 | B2 * | 4/2006 | Schmauder | 72/149 |
| 7,143,621 | B2 | 12/2006 | Bruyas et al. | |
| 7,234,333 | B2 | 6/2007 | Maier et al. | |
| 7,269,988 | B2 * | 9/2007 | Kobayashi | 72/149 |

FOREIGN PATENT DOCUMENTS

| | | |
|---|---|---|
| DE | 39 22 326 C2 | 11/1990 |
| DE | 201 18 444 U 1 | 3/2002 |
| DE | 601 00 147 T2 | 1/2004 |
| EP | 0 649 687 B1 | 4/1995 |
| EP | 0 649 688 A1 | 4/1995 |

(Continued)

*Primary Examiner* — Edward Tolan
(74) *Attorney, Agent, or Firm* — Patterson Thuente Christensen Pedersen, P.A.

(57) ABSTRACT

A support jaw arrangement for sliding lateral support of rod-shaped and tubular workpieces prior to their entrance into a forming groove of a bending head of a bending machine. The support jaw arrangement includes two support jaws, one on each side of the workpiece. Each support jaw is fastened on a holder to a support bracket which, guided in a longitudinally displaceable manner on a guide block, is displaceable by a drive device from an initial position retracted against the direction of transport of the workpiece parallel to the same, to an end position extended in the direction of transport of the workpiece. One support jaw supports the workpiece in a laterally sliding manner in a region from its tangential entrance into the forming groove, up to a point at a predetermined distance in front of the same while the other support jaw assumes a retracted initial position.

18 Claims, 5 Drawing Sheets

FOREIGN PATENT DOCUMENTS

| | | | |
|---|---|---|---|
| EP | 1 291 094 | B1 | 3/2003 |
| EP | 0 934 783 | B1 | 5/2006 |
| EP | 1 591 174 | B1 | 5/2008 |
| JP | 55-136519 | A | 10/1980 |
| JP | 11-138215 | A | 5/1999 |
| JP | 2001-96312 | A | 4/2001 |
| JP | 2001-225356 | A | 8/2001 |
| JP | 2008-175259 | A | 7/2008 |
| WO | WO 04/000479 | A1 | 12/2003 |

* cited by examiner

SUPPORT JAW ARRANGEMENT FOR SLIDING LATERAL SUPPORT OF ROD-SHAPED AND TUBULAR WORKPIECES IN BENDING MACHINES

This application claims the benefits of the priority based on European Patent Application No. 08 018 255.3 filed on Oct. 17, 2008, the disclosure of which is incorporated herein by reference in its entirety.

FIELD OF THE INVENTION

The invention relates to a support jaw arrangement for sliding lateral support of rod-shaped and tubular workpieces prior to their entrance into the forming groove of a bending head in a bending machine.

BACKGROUND

There is the likelihood in bending machines for bending rod-shaped or tubular workpieces by means of the bending head that the continuously fed workpiece to be processed is subjected to highly undesirable warpage (kinks, bulges, etc.) by the forces occurring during the bending in a certain region before its entrance into the forming groove of the bending form during the bending process in which it is bent in a circular manner, or in the manner of the segment of a circle, by means of a bending disk comprising a forming groove in which the workpiece is disposed, and an associated bending finger.

In order to prevent this, support jaws are placed in known bending machines in the mentioned region against the same on the side of the workpiece to be treated which is averted from the bending head and the bending disk.

DE 201 18444 U1 shows such an arrangement, with a support jaw being provided there which can be displaced along the tubular body and perpendicular to the same. This known support jaw arrangement can only be used in the case of a one-sided bending of the tubular workpiece because it allows support against bending forces on only one side.

In the support jaw arrangement from U.S. Pat. No. 4,959,984, a lateral support jaw is used which can be displaced perpendicularly to the longitudinal axis of the workpiece to be treated from an engagement position to a removed non-engagement position. Bending of this workpiece is also only possible on one side.

The same arrangement is principally also shown by DE 601 00 147 T2 and EP 0 934 783 B1 and DE 3922326 C2.

An apparatus is known from WO 2004/000479 A1 with which the workpiece to be processed can be bent to the right and left. A support jaw is placed in this case too in the region before the tangential entrance of the rod-shaped or tubular workpiece into the forming groove of the bending disk, with two such support jaws being provided here, one each for a bending direction, with each of which having a forming groove for placement against one side of the workpiece. The forming grooves on both support jaws as well as those on the bending disk are arranged in different axial height. In order to change over from right to left bending, complex rotation and pivoting motions and displacement motions along a clamping table are required in this known apparatus in order to displace the tool to the respectively opposite side of the bending head into the other forming groove of the same in the case of a fixed bending head and thus to also place the support jaws and the clamping devices on the other side of the bending head, by means of which the workpiece is guided during bending about the bending form. The constructional effort is considerable and the arrangement is very complex. As a result of the large overall size, the available bending space is restricted considerably to the side.

A further pipe bending machine is finally known from EP 0 649 687 B1 with which bending to the right and left is possible. Two support jaws are used in this case too, which are attached to opposite sides of the bending head and are each displaceable in the direction towards the workpiece to be processed until resting against the same. During the bending process, the respective support jaw which is in use will automatically follow the continuously conveyed tubular workpiece. The bending head is provided with a laterally protruding swivel arm to which two further clamping jaws which can be displaced individually on the bending head are attached for clamping the tube against a clamping element attached to the bending head, which clamping jaws produce the bending process after the clamping by pivoting the swivel arm about the swiveling axis of the bending head. When a changeover from one bending direction to another is desired, the swivel arm needs to be brought for this purpose to a pivoting position which is twisted by 180°, so that it can cooperate on the opposite side of the bending head with the other support jaw which is present there. This known bending machine is also complex in its configuration, with the support jaws having to be moved both in the longitudinal direction of the workpiece to be processed as well as perpendicular to its longitudinal axis. Furthermore, the forming grooves in the two forming jaws and the respectively associated forming grooves in the bending disk are disposed at different heights, also leading to a change of the height position of the overall arrangement relative to the fed strand-like workpiece during the changeover of the bending direction.

SUMMARY

On the basis of the above, the invention is based on the object of providing a support jaw arrangement which can be used both for right and left bending, with simple changeover and an entirely uncomplicated arrangement being provided.

This is achieved in accordance with the invention by a support jaw arrangement for sliding lateral support of rod-shaped and tubular workpieces prior to their entrance in the forming groove of a bending disk of a bending head of a bending machine, with two support jaws being provided for arrangement on either side of the longitudinal axis of the workpiece to be processed and each of the same is provided with a forming groove facing the workpiece for sliding contact with the same, with each further support jaw sitting on a support bracket by means of a holder, which support bracket, guided in a longitudinally displaceable manner on a guide block, is displaceable by an associated drive device from an initial position retracted against the direction of transport parallel to the same to an end position extended in the direction of transport of the workpiece in which it supports the workpiece in a laterally sliding manner in a region from its tangential entrance into the forming groove of the bending head up to a point at a predetermined distance from the same, with the other support jaw assuming its retracted initial position when a support jaw is disposed in its extended end position.

The support jaw arrangement in accordance with the invention has a comparatively simple constructional arrangement at first, in which it is necessary to produce only a lateral offset of the bending head relative to the longitudinal axis of the workpiece to be processed, e.g., by displacing the bending head, for the purpose of changing the bending direction. The arrangement of several forming grooves on the bending disk, which are axially offset in relation to each other, is not required, as also a lateral displaceability of the support jaws relative to the workpiece. It is only necessary to provide a threading between the two support jaws during the first time feeding of the workpiece, each of which rest laterally against the workpiece without clamping it tightly between themselves, because the function of each support jaw is not that of a clamping jaw, but they merely provide lateral support against the reaction forces on the workpiece triggered during the bending process. Since both support jaws always rest laterally on the workpiece, irrespective of whether they are each in their retracted or extending end position, it is merely necessary in changing over the bending direction to merely extend the required support jaw up to the tangential entrance point of the workpiece into the forming groove of the bending disk in addition to the lateral offset of the bending head and to simultaneously retract the other support jaw that is no longer required to its retracted initial position, which is the one remote from the bending head. In this way, a changeover of the bending direction can be achieved in combination with a simple configuration of the overall arrangement in a simple and quick way and in combination with only few adjusting movements.

In one embodiment of the invention, the two support brackets can be connected to a common drive device by means of which they can be displaced individually or together in opposite directions, which can be realized by means of a suitable lever mechanism, contra-rotating spindle drives or the like. Each support bracket is connected in an especially preferable way with a separate drive device, preferably a pneumatic cylinder or a servo drive.

The drive device(s) is/are are further advantageously connected to a central controller by which the adjusting movements are controlled during the change of the bending directions.

In the support jaw arrangement in accordance with the invention, the support jaws can be used either in such a way that the support jaw which is used for support is transferred immediately during its assignment from the initial position to its extended end position and is kept immovably in the same during the bending process. It can similarly also be provided, which can easily be realized within the scope of a program control of the drive device(s), that the respectively employed support jaw, in contact with the workpiece, is co-moved with the same during the bending process until it has reached its extended end position or is even guided beyond the same for a certain short section.

In an embodiment of the invention, each support jaw is made from hard plastic, especially from polyamide, so that especially low frictional forces can be achieved during a relative movement between the workpiece and the support jaw.

The support jaw arrangement can preferably be arranged in such a way that the support jaws, their holders, the support brackets, the guide blocks and the drive devices are provided symmetrically to the longitudinal axis of the workpiece, with a type of a bipartite and axially displaceable workpiece guidance also being achievable altogether.

The apparatus in accordance with the invention is suitable for processing rod-shaped or tubular workpieces, especially for tubular workpieces from the coil. It further reliably prevents any undesirable and unclean bending, kinking, bulging, etc. of the workpiece to be treated, so that only the actually desired deformation of the workpiece on the bending head is permitted.

In the support jaw arrangement in accordance with the invention, the holder, each of which carry one support jaw, is fastened in an especially preferred manner to the associated support bracket in a detachable way and is preferably displaceable in respect to its position in the direction towards the workpiece to be processed. In a similarly preferable way, each support jaw is also fastened in an exchangeable manner on the holder that supports the same in the invention, and it is also especially advantageously arranged to be adjustable in its position in the direction towards the workpiece to be processed and with respect to its height position. In this respect, each holder is preferably associated with an adjusting device for the support jaw, by means of which the same is adjustable in a fine manner relative to the holder in the direction perpendicular to the longitudinal axis of the support bracket and in its height position. For this purpose, any respectively suitable adjusting device can be used. It is especially preferable that an adjustment can be provided by means of one or several adjusting screws, especially with a fine thread.

It is similarly advantageous when a floating bearing of each support jaw on its holder can be provided instead, by means of which any offset in height can be compensated automatically.

Each support bracket can be guided in a longitudinally displaceable manner in any suitable way on the guide block which is associated with the same. Each support bracket is held in an especially preferable way by means of a recirculating ball guide or by means of a dovetail guide on the respectively associated guide block.

A further embodiment of the invention is also that the support jaw which is respectively used in a bending direction is moved during the bending process together with the workpiece until reaching its extended end position. The support jaw arrangement in accordance with an embodiment of the invention may be arranged in such a way that all its parts are fixed to a common base plate or a common base carrier for forming a modular unit for installation in a bending machine, through which even retrofitting a bending machine with a support jaw arrangement in accordance with the invention can be made rapidly.

The invention also comprises a bending machine for left and right bending of rodshaped and tubular workpieces by means of a bending head which can be offset laterally in relation to the longitudinal axis of the workpiece and which is provided with a support jaw arrangement in accordance with the invention with one of the configurations as mentioned above.

BRIEF DESCRIPTION OF THE DRAWINGS

The invention is now principally explained in closer detail in an exemplary manner by reference to the drawings, wherein.

DETAILED DESCRIPTION

Figure 1:
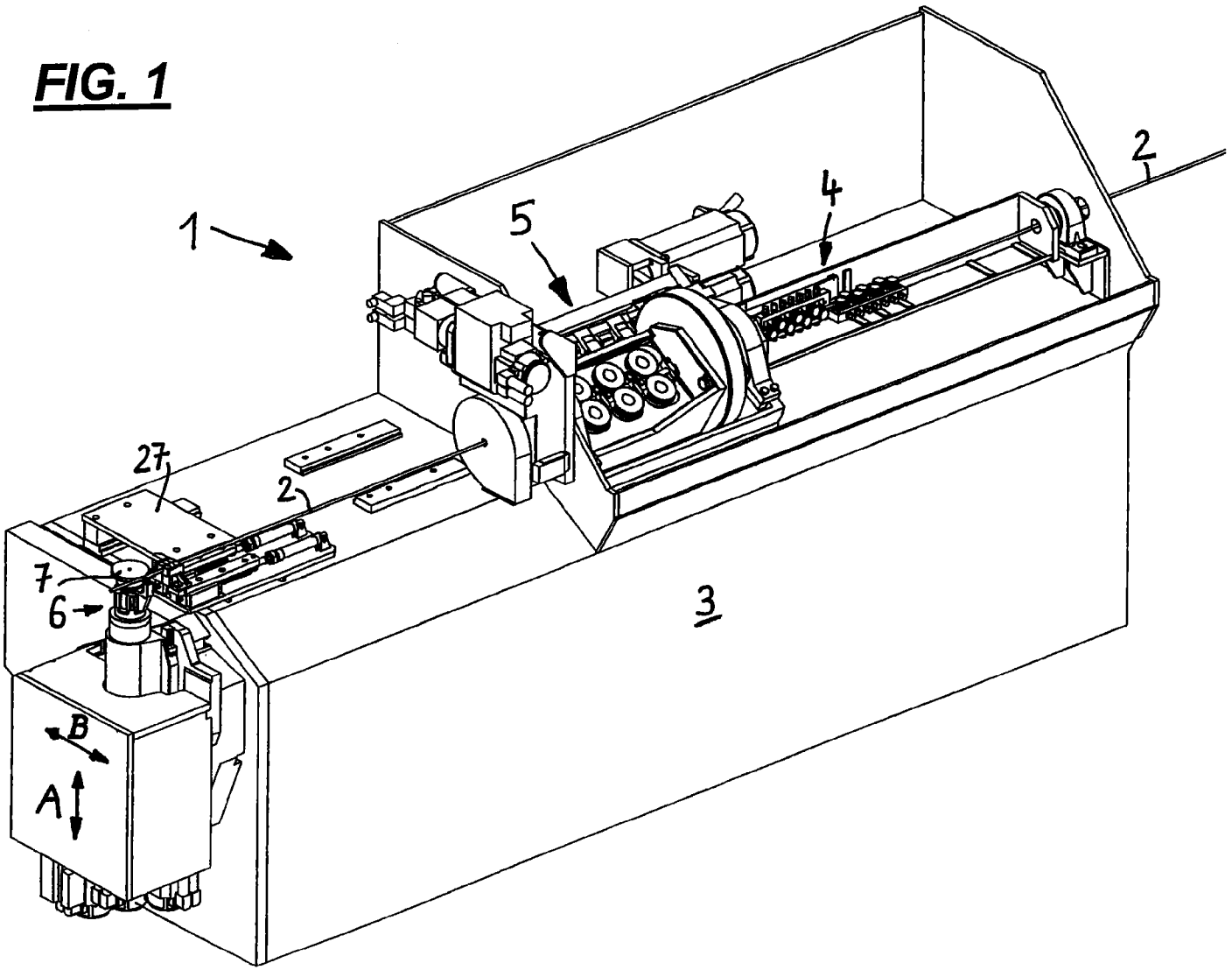
FIG. 1 shows a perspective view of a pipe bending machine with a support jaw arrangement in accordance with an embodiment if the invention.

FIG. 1 shows a perspective oblique view of a bending machine 1 for bending a rod-shaped or tubular workpiece 2 which is drawn off continuously from the coil.

The bending machine 1 comprises a machine frame 3 which is provided on its upper side with a straightening unit 4 and a rotatable feeder 5.

The workpiece 2 which is drawn off in a continuous manner from the coil is supplied at first from the rear side of the bending machine 1 (in FIG. 1: from the right) to the straightening unit 4, it passes through the same into the rotatable feeder 5, exits from the same at the front and is then supplied at the face side of bending machine 1 to a bending head 6 with a rotatable bending disk 7 for performing the desired bendings.

The bending disk 7 represents a bending form which is rotatable in both directions of rotation about a rotational axis 8 disposed in the perpendicular direction and perpendicular to the longitudinal axis of the workpiece 2.

It is provided with a forming groove 9 on the outer circumferential surface of bending disk 7 in which the workpiece 2 enters tangentially upon reaching the bending disk 7 and remains during the bending process.

A bending finger 10 is further attached to the bending head 6 which cooperates with the bending disk 7 for performing the bending process and can be pivoted with the same about the rotational axis 8 jointly (or even independently from one another). The workpiece 2 is arranged between the bending finger 10 and the forming groove 9 of the bending disk 7, which workpiece is bent during the twisting of the bending finger 10 and the bending disk 7 about the circumference of the latter according to the circular shape formed by the same.

As is illustrated by the arrows A and B, the bending head 6 is displaceable both in the perpendicular direction as well as in the transversal direction (i.e., perpendicularly transversally to the longitudinal axis of the workpiece 2).

Figure 5:
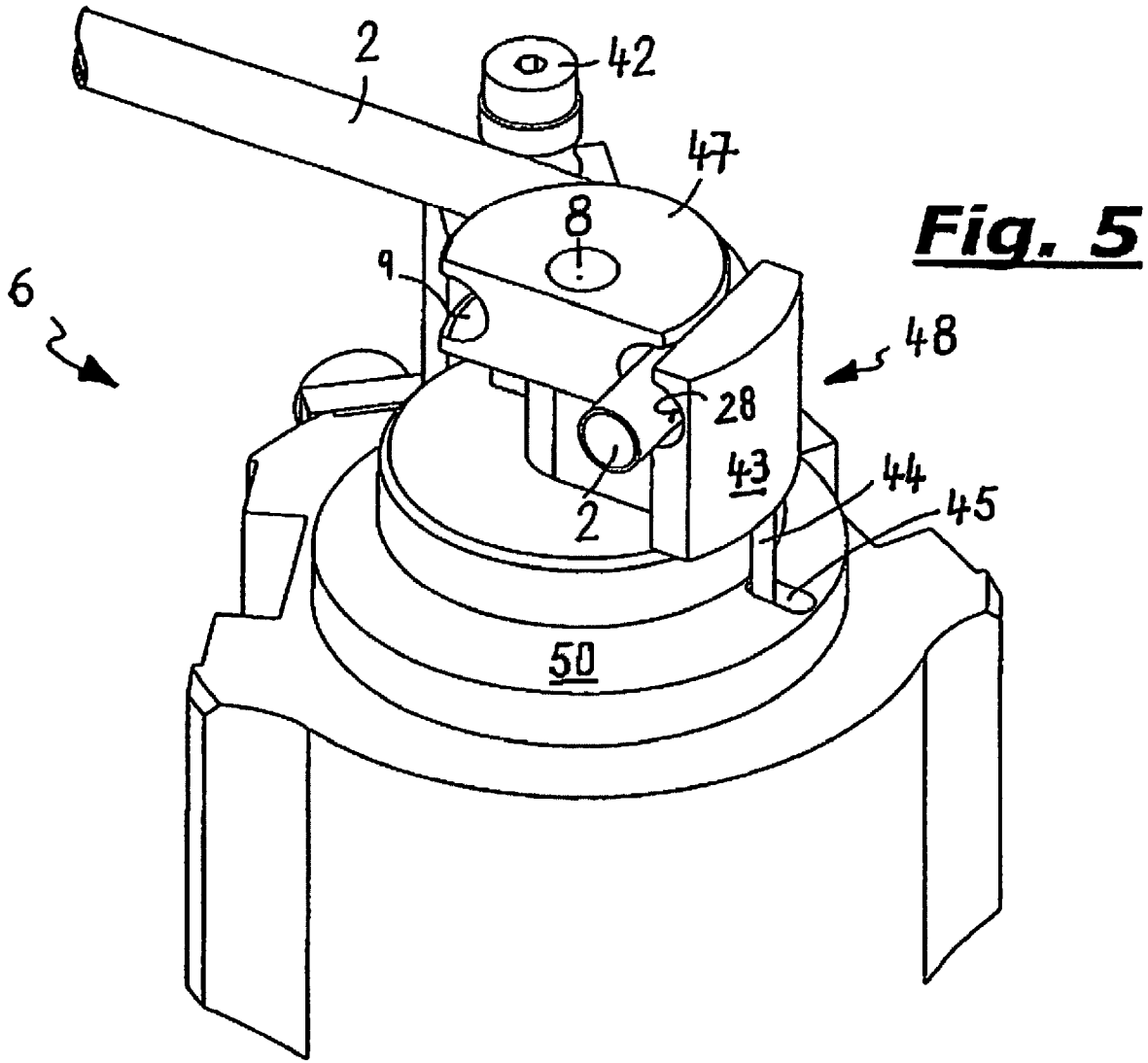
FIG. 5: shows an oblique perspective view to portray the principle of another embodiment of a bending head on a bending machine according to the present invention.

The bending head 6 is preferably arranged as is shown in detail in EP 1 591 174 B1, e.g. FIG. 13 of EP 1 591 174 B1, which is herein incorporated by reference in its entirety and briefly shown in instant FIG. 5. In the embodiment according to FIG. 5, the bending head 6 has a guide roller 42 mounted so that it can rotate freely and guides the workpiece 2 that is to be bent before it enters the forming groove 9 of bending mandrel 47. In the embodiment shown here, bending mandrel 47 comprises in principle a bending roller, which however does not have a complete circular circumference, but in which part of the circumference of the circle is cut away, as shown by FIG. 5, to which reference is made. In this embodiment, the clamping device 48 includes a clamping jaw 43 having a forming groove 28 of a size corresponding to the shape of the workpiece 6 that is formed, facing the workpiece 6 that is to be bent. The clamping jaw 43 is held by a holding device 44 portrayed in FIG. 5 only in principle (shown in FIG. 5 in the form of a pin), that is formed in a radially running slot guiding device 45 (in the form of an elongated hole) in a supporting plate 50. This holding device 44 is guided beneath support plate 50, e.g. in an eccentric guide groove (not visible) that passes around the central axis 8 of rotating head 6 for moving the clamping jaw 43 relative to the workpiece 2.

Figure 2:
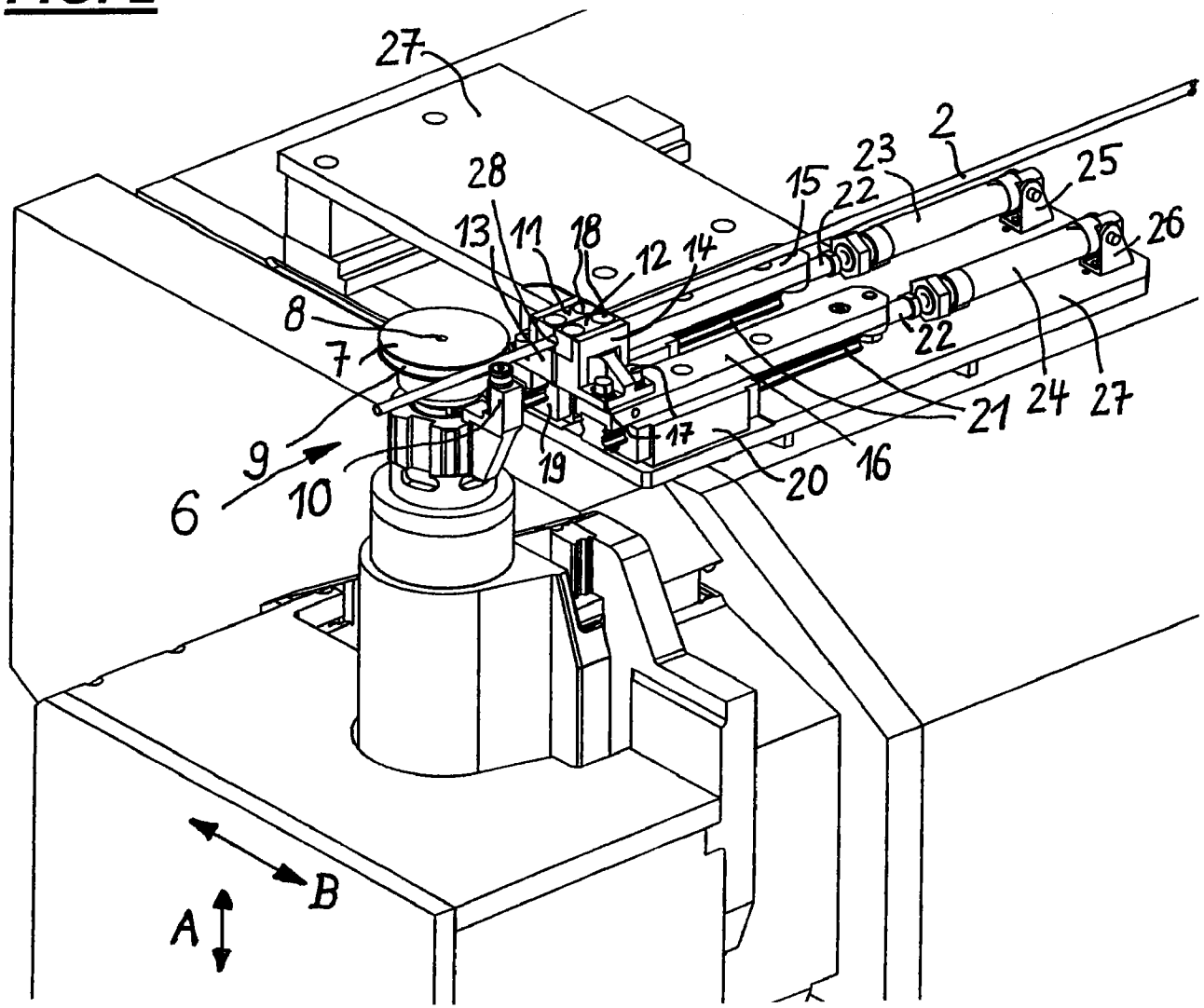
FIG. 2 shows an enlarged perspective partial section of the region of the pipe bending machine of FIG. 1 with the bending head and the support jaw arrangement in accordance with an embodiment of the invention.

As is shown especially in FIG. 2, the workpiece 2 passes through a support jaw arrangement before reaching the bending head 6. It consists of two support jaws 11, 12 which are arranged on either side of the workpiece 2 and each of which is attached to a holder 13 or 14, which on their part are each fixed to a support bracket 15 or 16 via screws 17. The screws 17 extend through oblong holes in a support flange of the holders 13 and 14, which support flange protrudes laterally, thus providing the possibility to displace the respective holder 13 and 14 in their fixing to the respective support bracket 15 and 16 relative to the same and in one direction perpendicular to the longitudinal axis of the workpiece 2 in a desired position and to fix them in the same.

Each support jaw 11, 12 is also fastened by means of screws 18 on the respectively associated holder 13 and 14, with a device being provided (not shown in the drawings) with which each support jaw 11, 12 can also be adjusted on its part in a fine manner in its position in the direction perpendicular to the workpiece 2. For this purpose, the screws 18 can each also be seated for example in slightly oblong accommodating bore holes of the associated support bracket in order to permit a fine adjustment of the respective support jaw 11, 12 relative to the workpiece 2. A device for height adjustment of the support jaws 11, 12 is also provided, which is not shown in FIGS. 1 and 2 however.

Each support bracket 15, 16 sits on an associated guide block 19 or 20 and is displaceably held on the same via a guide rail 21 in the longitudinal direction of the workpiece 2, with the guide rail 21 being fastened to the bottom side of the support bracket 15 or 16 and engaging in a respective dovetail groove in the associated guide block 19 or 20, so that in total one dovetail guide each is obtained.

Each support bracket 15, 16 is connected on its side averted from the bending head 6 via a push rod 22 with a drive device each in the form of a pneumatic adjusting cylinder 23, 24, which on its part is linked to a holding flange 25 and 26 about a pivoting axis disposed perpendicularly and transversally to the longitudinal axis of the workpiece 2.

The pneumatic cylinders 23, 24 are connected in a suitable manner to a central control device (not shown in the drawings), by means of which they can be triggered through a program control for example.

The guide blocks 19 and 20 are fastened to a base plate 27, as also the holding flanges 25, 26 for the pneumatic cylinders 23, 24, through which the entire support jaw arrangement plus its drive forms an inherently closed modular unit with said base plate 27, which modular unit can be fastened in a suitable manner to the frame 3 of the bending machine 1, as is shown for example in FIGS. 1 and 2.

The support frames 15 and 16, their respective push rod 22 and the associated pneumatic cylinders 23, 24 each extend in an orientation which is parallel to the longitudinal direction of the workpieces 2, with the support brackets 15 and 16 with the holders 13 and 14 and the respective support jaws 11, 12 attached thereto being transferred by the pneumatic cylinders 23 and 24 in a direction parallel to the longitudinal axis 2 from a retracted initial position, as is shown in FIGS. 1 and 2 and where each support jaw 11, 12 is remote from the bending disk 7, to an extended end position in which the extended support 11 and 12 is pushed forward with its front side facing the bending head 6 up to a point of the tangential entrance of the workpiece 2 into the forming groove 9 of the bending disk 7 and rests directly adjacent to the bending finger 10 of bending head 6. During a subsequently triggered twisting of the bending disk 7 with the bending finger 10, the workpiece 2 which engages between the two in the forming groove 9 of the bending disk 7 is provided with the desired bending about the bending disk 7, with the continuously supplied workpiece 2 being supported by the support jaws 11 and 12 in the forming groove 28 attached there in a region between the point of its tangential entrance into the forming groove 9 and a point disposed before this entrance point as seen the direction of transport of the workpiece 2 (as seen according to the length of the respective support jaw 11 and 12 in the longitudinal direction of the workpiece 2). It is this support especially in the region directly before the entrance of the workpiece 2 into the forming groove 9 which prevents the occurrence of cracks, warpages, etc. on the workpiece 2 which would otherwise occur by the bending forces occurring during the bending process.

The arrangements which each consist of a support jaw 11 and 12, the associated holder 13 and 14, the respective support bracket 15 and 16, the associated guide block 19 and 20, the respective push rod 22 and the connected pneumatic cylinder 23 and 24 are attached to the frame 3 of the bending machine 1 in such a way that each of the same lies on one side of the workpiece 2, with both arrangements, seen relative to the workpiece 2, being attached in their retracted initial position symmetrically with respect to one another.

Figure 3:
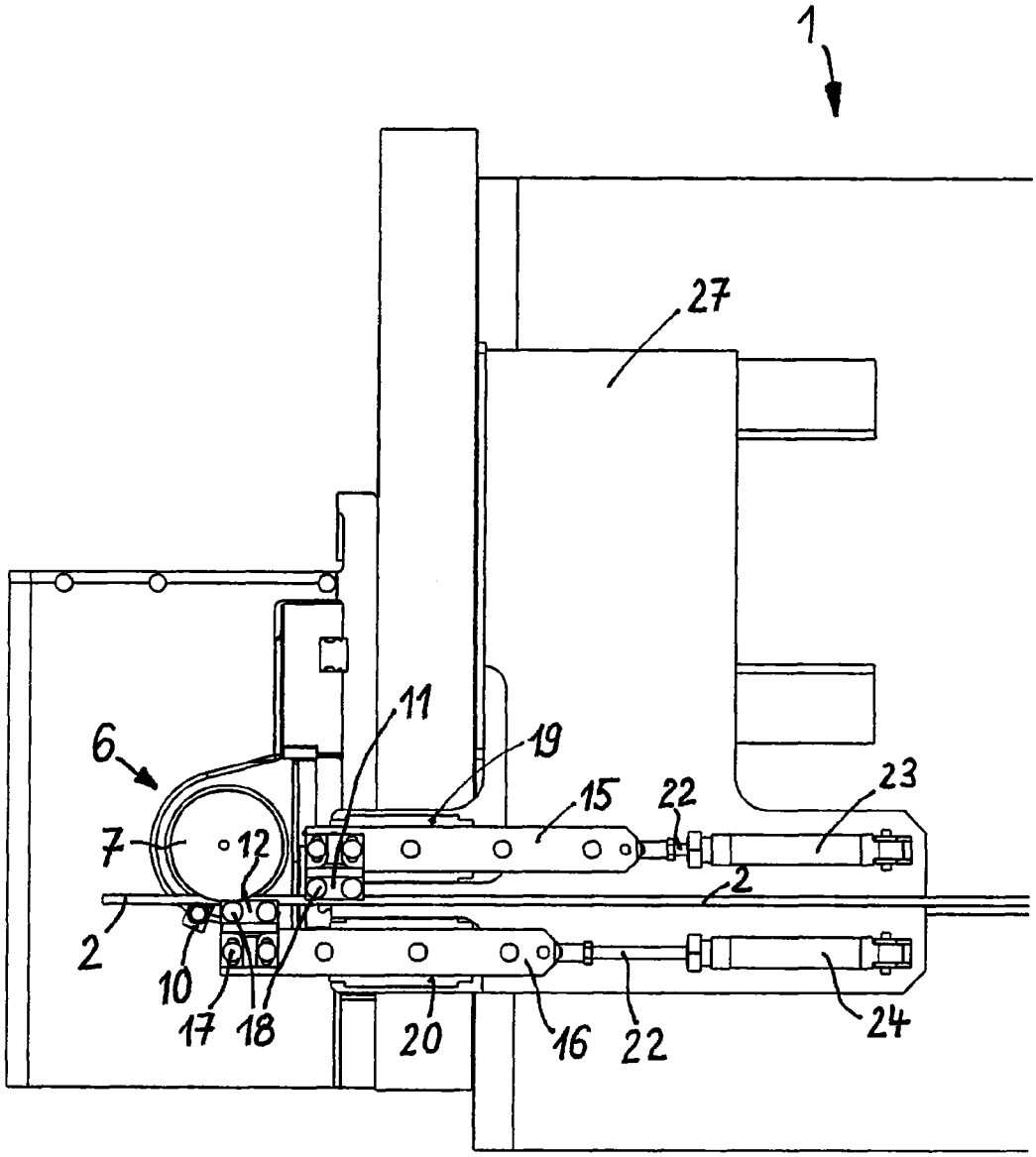
FIG. 3 shows a top view of the illustration of FIG. 2.
Figure 4:
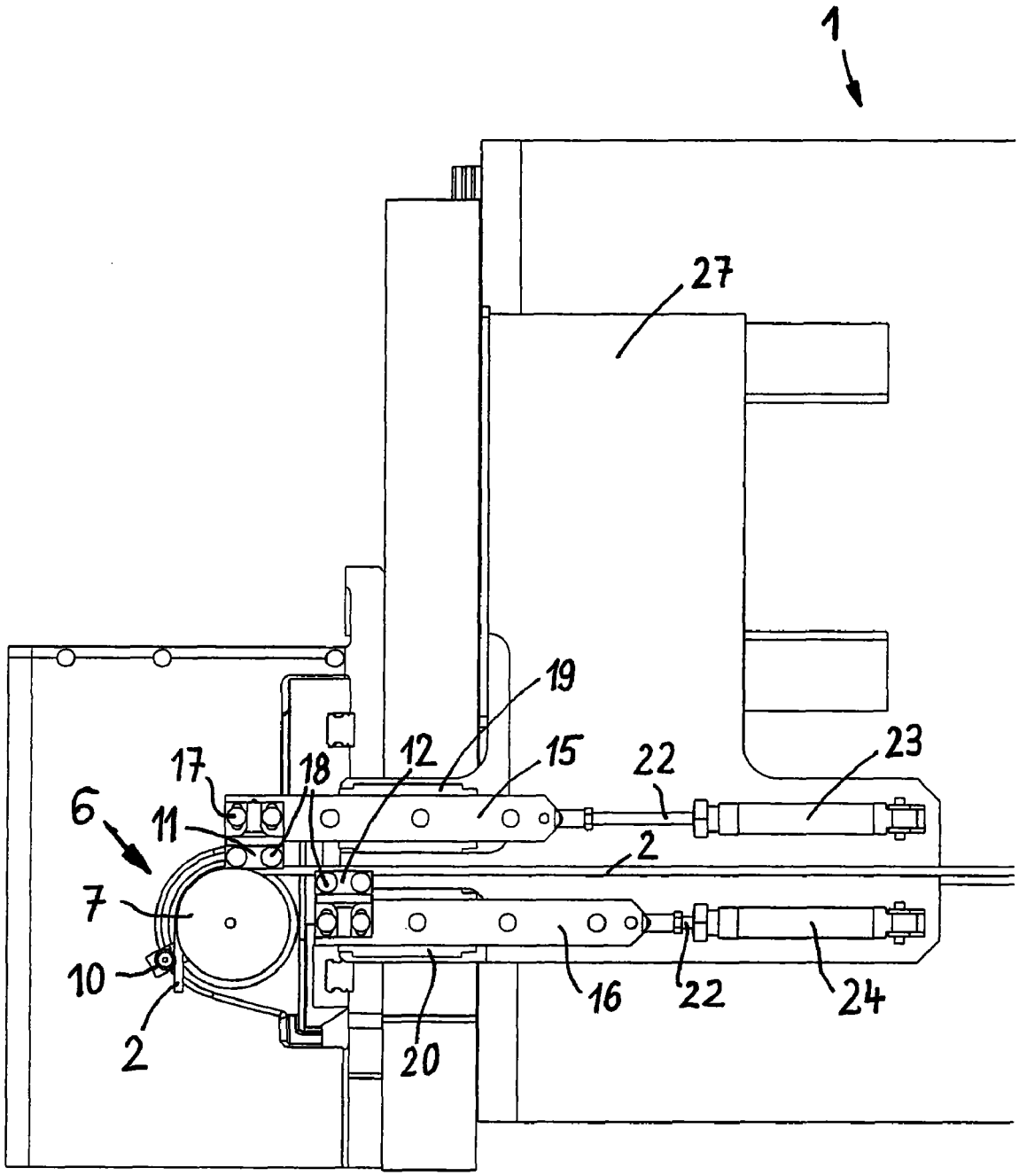
FIG. 4 shows a top view of the section of the bending machine of FIG. 2, but in the setting for left bending of the workpiece.

The control of the pneumatic cylinders 23 and 24 always occurs in such a way that always only the cylinder 23 or 24 which needs to assume the desired support in the intended direction of bending is located in its extended end position, whereas the other pneumatic cylinder is set to the retracted initial position of the support brackets 15 or 16 which is coupled with the same, as is shown for the two bending directions in FIG. 3 (for right bending) and FIG. 4 (for left bending).

FIG. 3 shows a top view of the section of the bending machine 1 which is shown in FIG. 2, which illustration shows the arrangement of the support jaws 11 and 12 with the elements 13 and 14, 15 and 16, which support the same, and the respective push rods 22 and the respectively associated pneumatic cylinder 23 and 24 on either side of the workpiece 2.

The illustration of FIG. 3 shows the case of right bending which has not yet begun in the position of FIG. 3, which is why workpiece 2 still protrudes beyond the bending head 6 and is only bent by a subsequent motion of the bending finger 10 and the bending disk 7. In this case, the support jaw 12 has been brought to its extended end position via the pneumatic cylinder 24 in which it is arranged, as is shown in FIG. 3, directly laterally adjacent to the bending finger 10 and is displaced with its front end region up to the point of the tangential entrance of the workpiece 2 into the guide groove 9 of bending disk 7. From here the support jaw 12 supports the workpiece 2 on its side opposite of the bending disk 7 over a longitudinal section which is disposed before the tangential entrance point and corresponds to the length of the support jaw 12, as seen in the longitudinal direction of the workpiece 2.

As is shown in FIG. 3, the other holding jaw 11 is brought to its retracted position by the pneumatic cylinder 23 which triggers the same, in which it also rests against the workpiece 2 on the other side, but is remote from the bending head 6 and the bending disk 7 of the same.

FIG. 4 shows the same section of the bending machine 1 as shown in FIG. 3, but with left bending in this case.

As is shown in FIG. 4 in comparison with FIG. 3, the bending head 6 with the bracket holding the same is displaced in FIG. 4 laterally to the workpiece 2 in such a way that the workpiece 2 is now disposed on the side of the bending disk 7 which is opposite in comparison with FIG. 3. If a changeover from right to left bending or vice-versa is to be performed during the treatment of the workpiece 2, it is necessary for this change of position of the bending head 6 not only to provide its lateral displacement in the direction of displacement B (see FIGS. 1 and 2), but also a lowering of the bending head 6 in the direction A (see FIGS. 1 and 2) in order to perform the lateral movement in the direction B beneath the workpiece 2 and to be brought upwardly again to the desired height position afterwards.

In this case, the support jaw 11, which in comparison with FIG. 3 is the other one, is brought by the pneumatic cylinder 23 to its advanced end position, whereas the support jaw 12 is displaced by pneumatic cylinder 24 to its initial position remote from the bending head 6 or bending disk 7.

In the illustration according to FIG. 4, the bending process is already substantially completed, with the bending finger 10 with the bending disk 7 already being twisted here to such an angular position that the workpiece 2 has been bent over by 90° to the left in relation to its direction of transport.

The arrangement of the support jaws 11 and 12 with the elements which carry and move them in such a way that they are disposed parallel with respect to one another and to the supplied workpiece 2 and are spaced from one another only so far that their forming grooves 28 always rest on either side of the workpiece 2 against the same leads to a very slender and compact overall arrangement which is also well suited for retrofitting an already existing bending machine. This compact arrangement can also be produced at respectively low cost, ensures large bending clearance and only requires the performance of small displacement movements in the support jaws 11 and 12 and a lateral displacement of the bending head 6 (optionally in conjunction with a prior lowering and subsequent lifting) for changing the bending direction. This also enables an especially rapid change of the bending direction in a workpiece 2 to be processed.

The support jaws 11 and 12 can assume different functions in the shown order:

They can be used in a fixed manner in a relative movement between the workpiece 2 and the support jaws 11 and 12 during the rotary-draw bending, but also controlled in the function of a sliding rail when there is no relative movement between workpiece and support jaws in rotary-draw bending with support jaws moved in the bending process, or also as a mere support element when there is no relative movement between the workpiece 2 and the support jaws 11 and 12 in mere edge rolling with unmoved workpiece 2 and unmoved support jaws 11 and 12.

What is claimed is:

1. A support jaw arrangement for sliding lateral support of rod-shaped and tubular workpieces prior to their entrance into a forming groove of a bending disk of a bending head of a bending machine, comprising:

a first support jaw and a second support jaw, the first support jaw disposed on a first side of a longitudinal axis of a workpiece to be processed and defining a first groove facing the workpiece, the second support jaw disposed on a second side of the longitudinal axis of the workpiece and defining a second groove facing the workpiece, the first and second grooves sized to receive and support the workpiece, while allowing the workpiece to slide through the grooves when the workpiece is in transport;

a first guide block operably coupled to the first support jaw, and a second guide block operably coupled to the second support jaw, the first and the second support jaws longitudinally displaceable along the first and second guide blocks, respectively, in directions parallel to a direction of transport of the workpiece, and between positions of retraction and of extension; and wherein the first support jaw disposed at its position of extension provides lateral support to the workpiece being bent in a first direction, while the second jaw remains in its position of retraction, and the second support jaw disposed at its position of extension provides lateral support to the workpiece being bent in a second direction, while the first jaw remains at its position of retraction, both the first support jaw and the second support jaw always resting laterally against the workpiece irrespective of whether each the first and second support jaws remain in their respective position of retraction or disposed at their respective position of extension.

2. The support jaw arrangement of claim 1 further comprising a first support bracket and a second support bracket, the first support bracket slidably attached to the first guide block and supporting the first support jaw, and the second support bracket slidably attached to the second guide block and supporting the second support jaw.

3. The support jaw arrangement of claim 2, further comprising a first holder carrying the first support jaw and attached to the first support bracket, and a second holder carrying the second support jaw and attached to the second support bracket.

4. The support jaw arrangement of claim 2, further comprising a drive device operably coupled to the first and second support jaws for longitudinally displacing the first and second support jaws along the guide blocks.

5. The support jaw arrangement of claim 2, wherein the first support bracket is held by a first recirculating ball guide on the first guide block and the second support bracket is held by a second recirculating ball guide on the second guide block.

6. The support jaw arrangement of claim 2, wherein the first support bracket is held by a first dovetail guide on the first guide block and the second support bracket is held by a second dovetail guide on the second guide block.

7. The support jaw arrangement of claim 3, further comprising first and second adjusting devices on the first and second holders, respectively, the first and second adjusting devices adjustable in a fine manner relative to its holder in a direction perpendicular to the longitudinal direction of its support bracket and in its height position.

8. The support jaw arrangement of claim 3, wherein the first holder is detachably fastened to the first support bracket, the second holder is detachably fastened to the second support bracket, and each of the first and the second holders are adjustable so as to move in a direction toward or away from the workpiece.

9. The support jaw arrangement of claim 4, wherein the drive device includes a first drive device operably coupled to the first support jaw and a second drive device operably connected to the second support jaw.

10. The support jaw arrangement of claim 4, wherein a central controller is provided for controlling the drive device.

11. The support jaw arrangement of claim 4, wherein the drive device comprises one or more pneumatic cylinders or one or more servo drives.

12. The support jaw arrangement of claim 1, wherein the the workpiece is supported by the first or second support jaw in a region from a tangential entrance of the workpiece into a first side of a forming groove of a bending disk up to a point at a predetermined distance in front of the bending disk.

13. The support jaw arrangement of claim 1, wherein each of the first and second support jaws is made of hard plastic.

14. The support jaw arrangement of claim 1, further comprising a base plate supporting the first and second support jaws and the first and second guide blocks thereby forming a modular unit for installation in a bending machine.

15. A bending machine for left and right bending of rod-shaped and tubular workpieces, comprising:

a bending head which is displaceable laterally to a longitudinal axis of a tubular workpiece; and a support jaw arrangement for supporting the tubular workpiece during left and right bending, including:

a left support jaw and a right support jaw, the left support jaw disposed on a left side of the longitudinal axis of the workpiece, the right support jaw disposed on a right side of the longitudinal axis of the workpiece, the left and the right support jaws providing sliding lateral support for the workpiece;

a left guide block operably coupled to the left support jaw, and a right guide block operably coupled to the right support jaw, the left and the right support jaws longitudinally displaceable along the left and right guide blocks, respectively, in directions parallel to a direction of transport of the workpiece, and between positions of retraction and of extension; and wherein the left support jaw disposed at its position of extension provides lateral support to the workpiece being bent in a right direction by the bending head disposed to the right side, while the right jaw remains in its position of retraction, and the right support jaw disposed at its position of extension provides lateral support to the workpiece being bent in a left direction by the bending head disposed to the left side, while the left jaw remains at its position of retraction, both the first support jaw and the second support jaw always resting laterally against the workpiece irrespective of whether each the first and second support jaws remain in their respective position of retraction or disposed at their respective position of extension.

16. The bending machine of claim 15, wherein the support jaw arrangement further comprises a left support bracket and a right support bracket, the first support bracket slidably attached to the first guide block and supporting the first support jaw and the second support bracket slidably attached to the second guide block and supporting the second support jaw.

17. The bending machine of claim 16, wherein the support jaw arrangement further comprises a first holder carrying the first support jaw and attached to the first support bracket, and a second holder carrying the second support jaw and attached to the second support bracket.

18. The bending machine of claim 15, wherein the support jaw arrangement further comprises a drive device operably coupled to the first and second support jaws for longitudinally displacing the first and second support jaws along the guide blocks.

* * * * *